US008196388B2

(12) United States Patent
Park et al.

(10) Patent No.: US 8,196,388 B2
(45) Date of Patent: Jun. 12, 2012

(54) HEATING DEVICE FOR EXHAUST GAS IN INTERNAL COMBUSTION ENGINE

(75) Inventors: Jong-Soo Park, Daejeon (KR); Young-Jae Lee, Daejeon (KR); Wang-Lai Yoon, Daejeon (KR); Ho-Tae Lee, Daejeon (KR); Dong-Joo Seo, Daejeon (KR); Sung-Ho Cho, Daejeon (KR); Shin-Kun Lee, Gyeonggi-do (KR); Seung-Hoon Choi, Daejeon (KR); Kyung-Seun Yoo, Seoul (KR)

(73) Assignee: Korea Institute of Energy Research, Daejeon (KR)

( * ) Notice: Subject to any disclaimer, the term of this patent is extended or adjusted under 35 U.S.C. 154(b) by 1050 days.

(21) Appl. No.: 12/088,796

(22) PCT Filed: Sep. 29, 2006

(86) PCT No.: PCT/KR2006/003927

§ 371 (c)(1),
(2), (4) Date: May 28, 2008

(87) PCT Pub. No.: WO2007/037652

PCT Pub. Date: Apr. 5, 2007

(65) Prior Publication Data

US 2008/0282687 A1 Nov. 20, 2008

(30) Foreign Application Priority Data

Sep. 30, 2005 (KR) ..... 10-2005-0092205
Jun. 12, 2006 (KR) ..... 10-2006-0052699

(51) Int. Cl.
*F01N 3/00* (2006.01)
*F01N 3/10* (2006.01)

(52) U.S. Cl. ..... 60/282; 60/300; 60/303; 431/5; 431/7; 431/11; 431/170; 431/207; 431/240; 431/242; 431/243; 431/247

(58) Field of Classification Search ..... 60/282; 431/5, 7, 11, 170, 207, 240, 242, 243, 247
See application file for complete search history.

(56) References Cited

U.S. PATENT DOCUMENTS 3,775,064 A * 11/1973 Berger et al. ..... 422/171
(Continued)

FOREIGN PATENT DOCUMENTS

KR 09-222009 8/1997
(Continued)

*Primary Examiner* — Thomas Denion
*Assistant Examiner* — Jason Shanske
(74) *Attorney, Agent, or Firm* — Baker & Hostetler LLP

(57) ABSTRACT

The present invention relates to a heating device for exhaust gas in an internal-combustion engine, which is driven by using LPG, LNG, a volatile oil, a light oil, biodiesel or oxygenated hydrocarbon being DME, the device consisting of a catalyst reactor reformer, an exhaust gas suction section and the second fuel supply device. The exhaust gas suction section is mounted for using oxygen included in the exhaust gas. When the heating device is driven, air and fuels are supplied to the catalyst reactor and the second fuel supply device via a single tube when the heating device is heated. The present invention provides with a heating device for exhaust gas capable of securing the durability of a heating device for exhaust gas and minimizing the amount of air supplied from the outside to the combustion reforming device by excluding carbon depositions in a tube due to a prolysis of LPG, LNG, a volatile oil, a light oil, biodiesel or oxygenated hydrocarbon being DME, and a method for driving the device.

11 Claims, 5 Drawing Sheets

U.S. PATENT DOCUMENTS 5,343,699 A * 9/1994 McAlister ..... 60/273
5,417,059 A * 5/1995 Hartel et al. ..... 60/276
5,839,273 A 11/1998 Maus
6,223,537 B1 * 5/2001 Lipinski et al. ..... 60/723
6,851,947 B2 * 2/2005 Sugimoto et al. ..... 431/7
6,955,042 B1 * 10/2005 Wnuck et al. ..... 60/286
7,008,219 B2 * 3/2006 Shimada et al. ..... 431/215
7,037,349 B2 * 5/2006 Dauer et al. ..... 48/214 A
2002/0160330 A1 * 10/2002 Eroglu et al. ..... 431/278
2003/0096204 A1 * 5/2003 Hermann et al. ..... 431/7
2004/0115490 A1 * 6/2004 Kaupert et al. ..... 429/13
2005/0150220 A1 * 7/2005 Johnson et al. ..... 60/295
2005/0188615 A1 * 9/2005 Sennoun et al. ..... 48/127.9

FOREIGN PATENT DOCUMENTS

KR 090217619 8/1997

* cited by examiner

PRIOR ART
[Fig. 1]
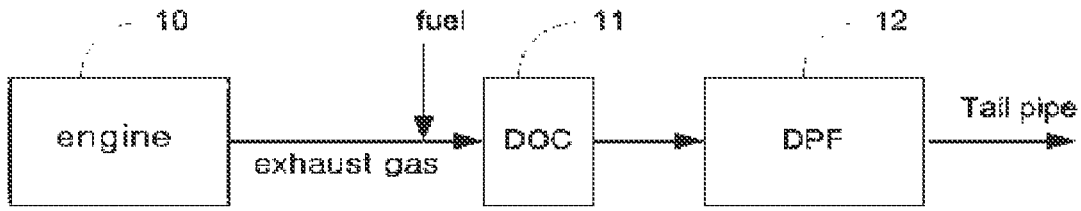
[Fig. 2]
PRIOR ART
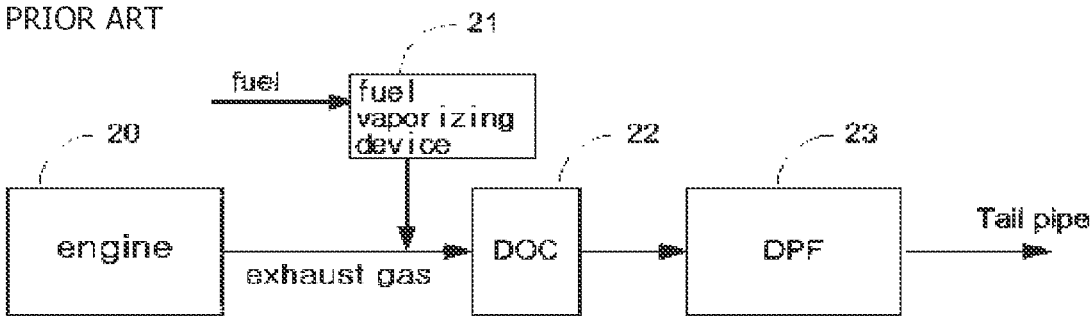
[Fig. 3]
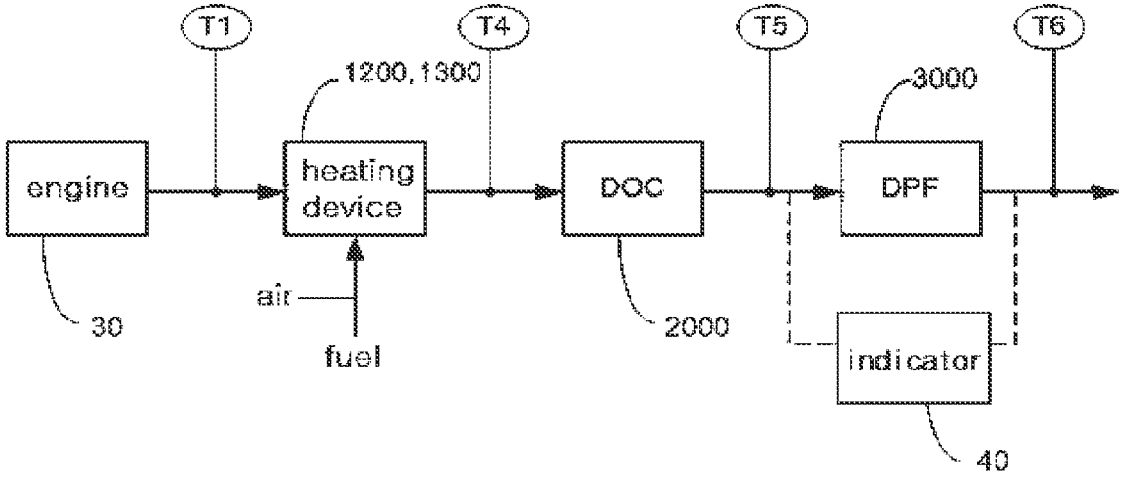

[Fig. 4]
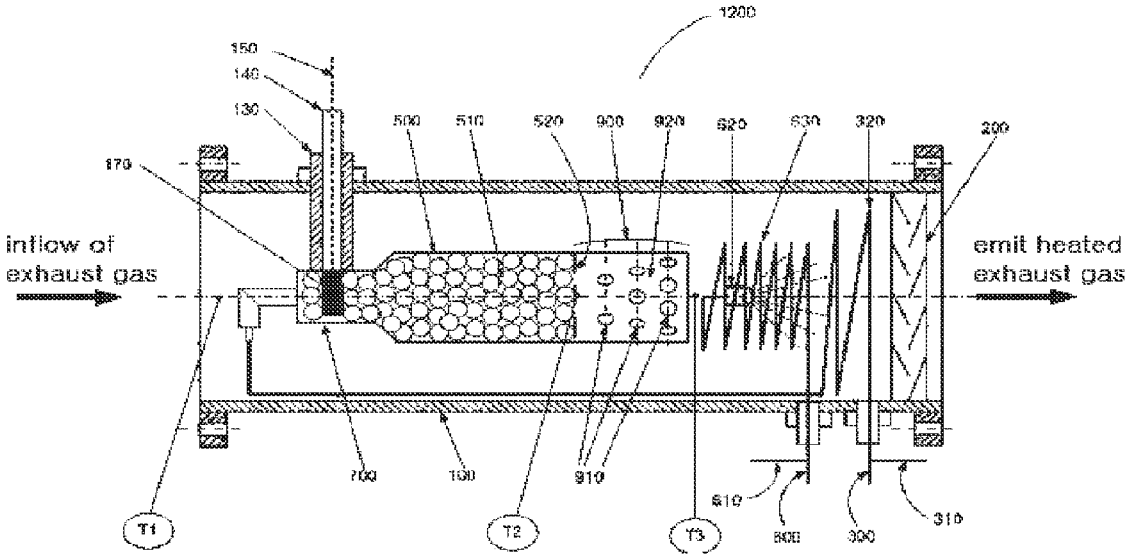
[Fig. 5]
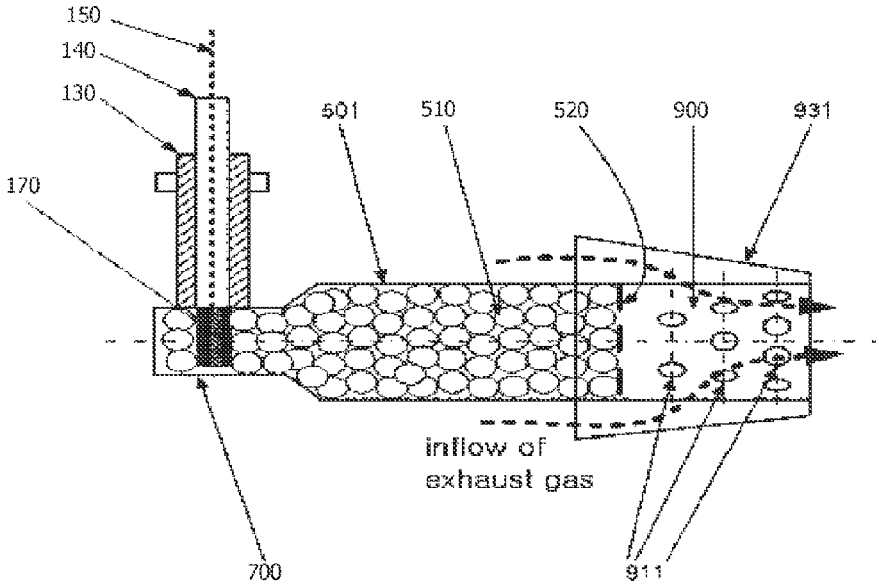

[Fig. 6]
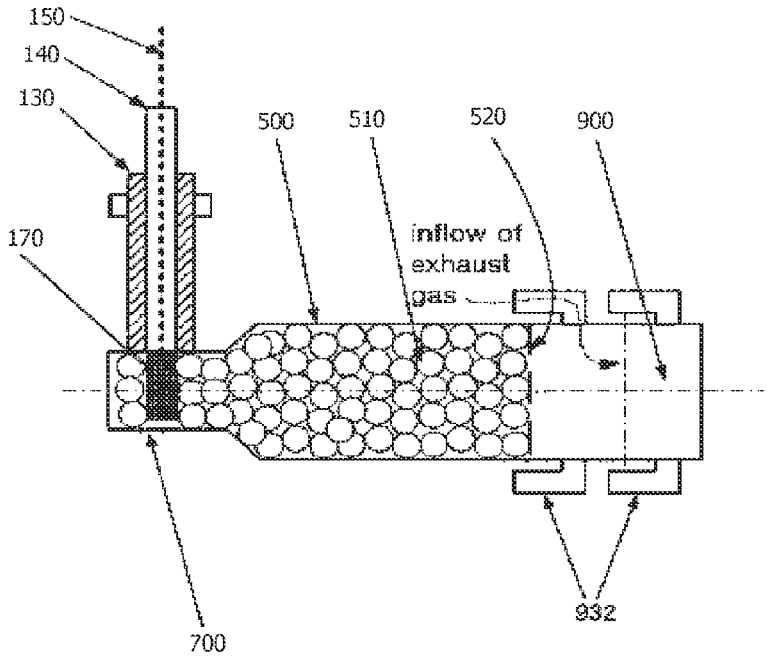
[Fig. 7]
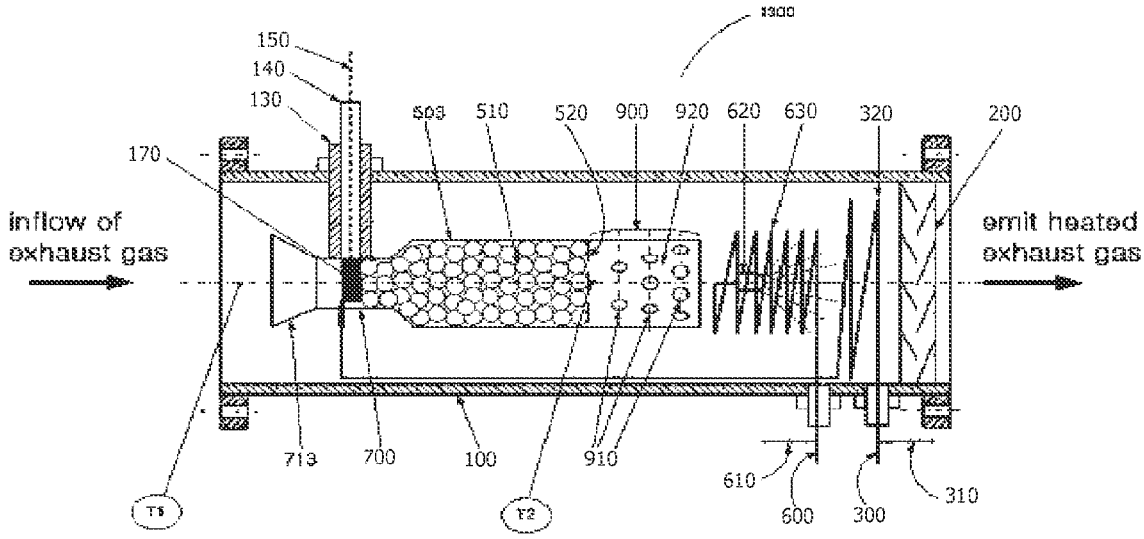

[Fig. 8]
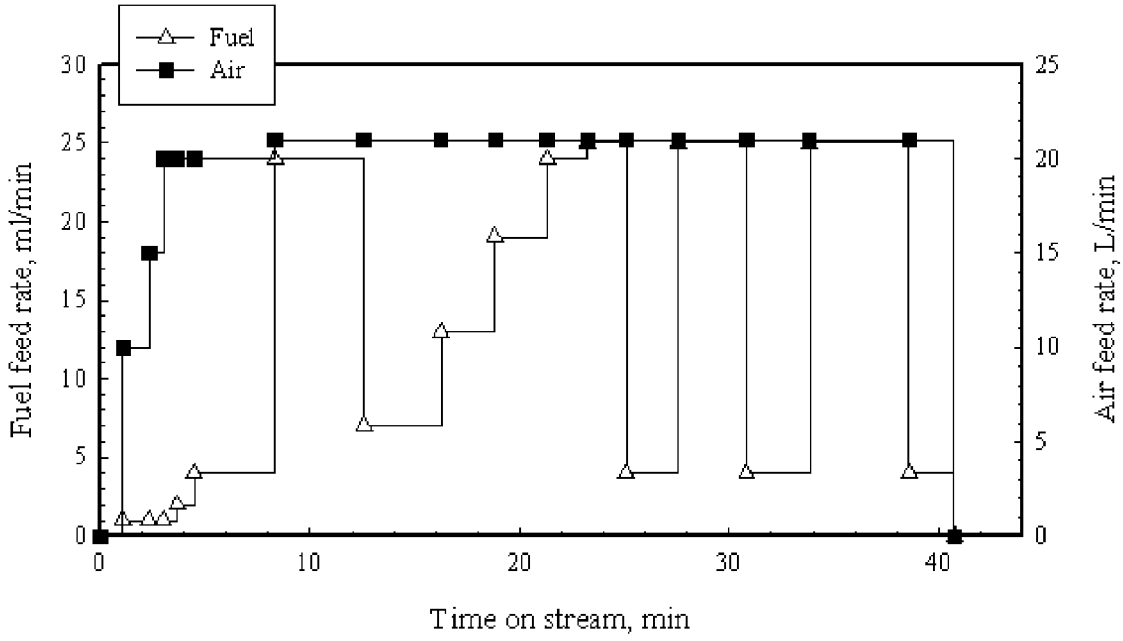
[Fig. 9]
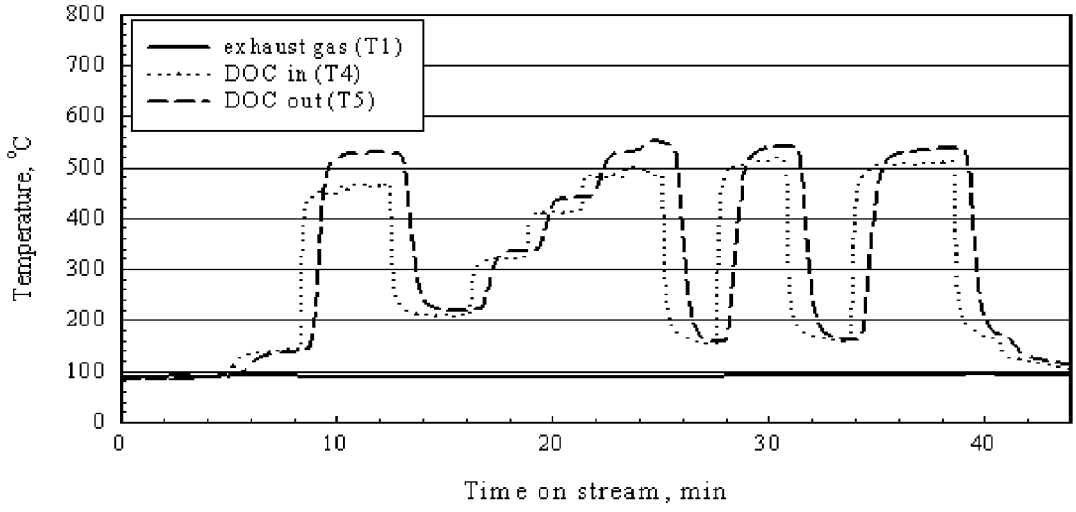

[Fig. 10]
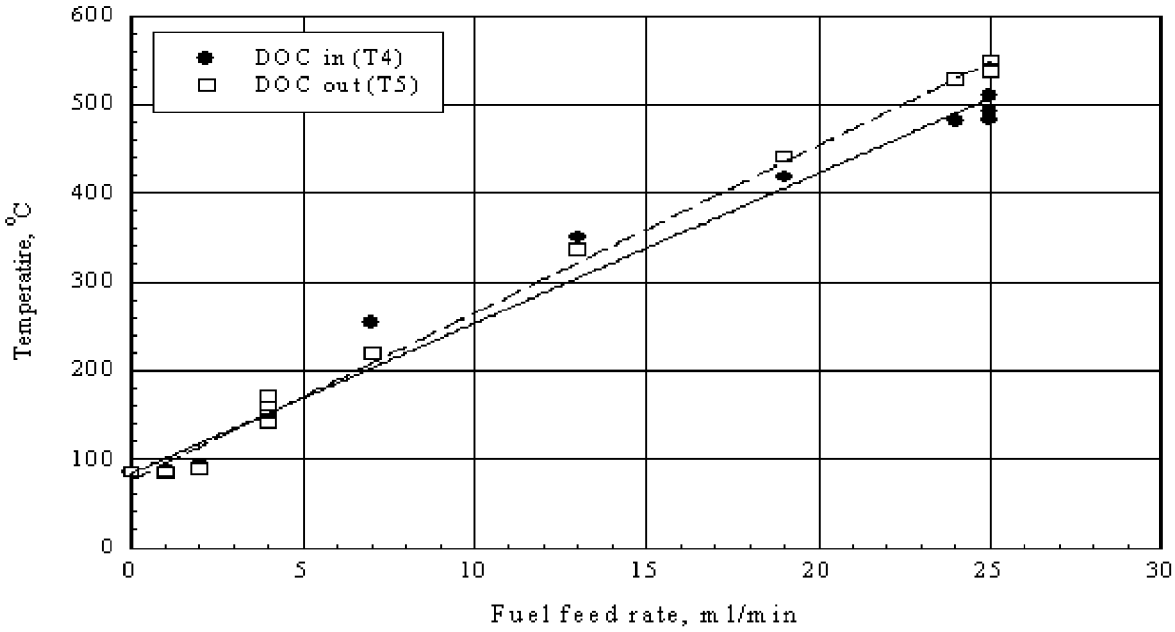

HEATING DEVICE FOR EXHAUST GAS IN INTERNAL COMBUSTION ENGINE

TECHNICAL FIELD

The present invention relates to a heating device for exhaust gas in an internal combustion engine, more particularly, to a heating device for exhaust gas in an internal combustion engine required for heating a purifying device for exhaust gas in an internal combustion engine which is driven by using LPG, LNG, a volatile oil, a light oil, biodiesel or oxygenated hydrocarbon being DME (referred to as "fuel", hereinafter).

BACKGROUND ART

The vehicles driven by an internal combustion engine continuously emit particulate matter and nitrogen oxides which are major reasons of pollutions, therefore the environmental regulations on the exhaust gas of the vehicles have been strengthening.

As a method for removing the pollutants, an effort to decrease the emission of pollutants in advance by maximizing the efficiency of engines and upgrading fuels. As well as researches on post-cleaning of exhaust gas such as a filter for removing particulate matter and a catalyst for abating nitrogen oxide haven been conducted.

However, a process for post-cleaning exhaust gas in the above efforts is dependent on the state of vehicles and their driving conditions a lot, therefore the condition to which this method is applied are greatly limited.

The plans for utilizing a heat by an electric heater or a burner as an energy source for regenerating filters are currently tried but the limited power and a space required for establishing an external burner should be overcome so that it is applied to the system.

Recently, a plurality of patent applications to convert hydrocarbon into a combustable reduced gas for applying to the vehicle have been filed, but could not suggest a concrete system configuration required for combustion and reformation.

If hydrocarbon is sprayed into the exhaust gas in the condition of the low temperature of the exhaust gas, a recondensation should proceed with a temperature below the boiling point of a light oil, So additional heating devices for the exhaust gas should be mounted for preventing the recondensation.

In an effort to supplement the above, a method has been suggested to transfer the light oil into vapors by using a vaporizer driven by electricity, and mixing it with the exhaust gas to combust it on DOC (Diesel Oxidizing Catalyst).

However, it is impossible to combust the vaporized diesel below than 235° C. in DOC, and the periods for spraying fuels are limited because it is necessary to prepare for recondensations of the fuels vaporized due to a low temperature of the exhaust gas.

FIG. 1 is a general configurational view for heating DPF (Diesel Particulate Filter) (12) by spraying fuels. A vaporized fuel with heat source is mixed with an exhaust gas generated from the engine (100) and is introduced into the DOC (11). The exhaust gas and fuel are oxidized in the DOC (11) to generate heat which can be used as a heat source so that the DPF (Diesel Particulate Filter) (12) is reproduced.

The DOC (11) is served for combusting a fuel which is supplied to SOF (Soluble Organic Fraction) and DPF (Diesel Particulate Filter) in carbon monoxide, hydrocarbon and particulate matters which is contained in exhaust gas.

The DPF (12) has a configuration to be disposed in serial at the rear end of the DOC, and collects the particulate matter in exhaust gas to keep the particulate matter from being released. If more than a predetermined amount of the particulate matter is collected, they are combusted and regenerated by a heat supplied from a supplementary heat energy source.

In FIG. 1, the heat generated from the DOC (11) is used.

In FIG. 2, a fuel vaporizing device (21) is further comprised in comparison with FIG. 1, and supplies the vaporized fuel (especially, a light oil) to an exhaust gas stream to improve the mixing it with the exhaust gas, functioning as promoting oxidation in the DOC (22).

The collected particulate matter by DPF (made of metal or ceramic material), especially in a diesel vehicle, is oxidized continuously or is combusted periodically to regenerate the filter.

The period for regenerating the filter has a variation in accordance with a NOx/soot ratio and temperature distributions of exhaust gas. The temperature of exhaust gas is subjected to vehicle models, engine types, road situations and traffic conjestions etc. and the Nox/soot rate is also variable in accordance with an EGR rate.

In other words, it is impossible to change the driving conditions of an engine in a vehicle on the road so as to control the temperature of an exhaust gas in consideration of capacities of a post-cleaning device, and we need a supplementary heating system for heating exhaust gas.

DISCLOSURE OF INVENTION

Technical Problem

An object of the present invention, which is made in order to solve the above-mentioned problems, is to provide a heating device for exhaust gas capable of minimizing the amount of air supplied from a outside air supply unit to the catalytic reactor for reforming reaction of diesel fuel, and regenerating DPF independently of vehicle driving conditions.

Another object of the present invention is to provide with a system configuration for keeping coke from being accumulated inside a tube for supplying hydrocarbon in the heating device the exhaust gas, and an operating method thereof.

Still another object of the present invention is to provide with an apparatus for manufacturing a reducing gas for removing nitrogen oxide which supplies a reducing gas for removing nitrogen oxide from a predetermined gas, including a heating device for exhaust gas in an internal combustion engine.

Technical Solution

In order to achieve the above objects, the present invention has an exhaust gas suction hole so that a part of exhaust gas is transmitted (sucked) in the rear end of the catalyst reformer, leading the reducing gas emitted from the reforming reactor to be ignited. Thus, the amount of the air supplied from the outside is minimized and the oxygen included in the exhaust gas is utilized as an oxidizing agent.

In addition, the present invention is characterized in that air and fuel are simultaneously supplied into a catalyst reactor consisted of a combustion reforming catalyst and an electronic heater in an exhaust gas conduit.

The exhaust gas suction hole is mounted at the rear end of the reforming catalyst layer and a reforming gas is combusted to vaporize the second fuels and form an ignitable hot part.

Likewise, the amount of air supplied from the outside is able to remarkably reduce by utilizing oxygen of the exhaust gas.

Accordingly, it is possible to minimize an electric energy required for driving an air compressor.

In addition, as the reactor configured to introduce a part of exhaust gas into the catalyst reactor minimizes the amount of sucking the exhaust gas and inhales an oxidizing agent by the second suction with a relatively low pressure loss, it is possible to minimize the pressure loss in an emission pipe and alleviate the decrease of a mileage.

The fuel/air supply line according to the present invention is characterized to be formed to increase the retention time and the heat transfer area for vaporizing the fuel inside thereof.

In addition, the fuel/air supply line is characterized to have a helical shape forming to the parallel direction to the longitude of the conduit in the inside of it.

Moreover, when it comes to injecting the fuel and air, the fuel and the air are alternately supplied with a time interval.

Furthermore, according to the present invention, a reducing gas is heated at a hot part formed by ignition by the reforming gas or/and a reforming portion is placed at the hot part at the same time. The emission part of the reforming gas is positioned below 400° C. (changeable according to the types of the engine) to refrain from the natural ignition so as to transmit the reforming gas to the catalyst surface.

Advantageous Effects

The heating device for an exhaust gas according to the present invention can heat an exhaust gas to a necessary temperature, independently from the load of an engine and its rotational state. Accordingly, the device according to the present invention is expected to be used as a core module required for constituting the third generational DPF system for a medium sized diesel vehicle which is difficult to be self regenerated.

BRIEF DESCRIPTION OF THE DRAWINGS

FIG. 1 is a configurational view of DPF heating system due to a fuel spray in the prior art.

FIG. 2 is a configurational view of DPF heating system using a fuel evaporator in the prior art.

FIG. 3 is a configurational view of a DPF heating system according to the present invention.

FIG. 4 shows an embodiment of a heating device for exhaust gas according to the embodiment 1 of the present invention.

FIG. 5 shows a configuration of a portion for sucking the exhaust gas according to the embodiment 2 of the present invention.

FIG. 6 shows a configuration of a portion for sucking the exhaust gas according to the embodiment 3 of the present invention.

FIG. 7 shows a configuration of a heating device for exhaust gas according to the embodiment 4 of the present invention.

FIG. 8 shows a change of experimental conditions according to the embodiment 3.

FIG. 9 shows an experimental result according to the embodiment 3.

FIG. 10 shows an experimental result according to the embodiment 3.

BEST MODE FOR CARRYING OUT THE INVENTION

Hereinafter, the embodiments of the present invention will be described in detail with reference to the attached drawings. Reference now should be made to the drawings, in which the same reference numerals are used throughout components in the following description of the present invention, detailed descriptions may be omitted if it is determined that the detailed descriptions of related well-known functions and constructions may make the gist of the invention unclear.

According to the present invention, a catalyst reactor is positioned in the exhaust gas stream to prevent overheating the catalyst reactor by an exhaust gas, and at the same time to induce the combustion of the hydrocarbon with the oxygen included in the exhaust gas. The generated heat energy with combustion is useful for heating up DOC, DPF, De-$No_x$ catalyst and $No_x$ trap which is not indicated in the drawings.

In addition, according to the present invention, the second fuel spray section is provided for the rear part of the catalyst reactor.

A preheating section or a vaporizing area is provided so that the exhaust gas is heated over 350° C. to be vaporized before the second fuel/air is sprayed. The source for heat does not require for additional heating devices to be mounted at the rear hot part of the catalyst reactor.

In addition, the second fuel/air supply line is provided with the convenience for controlling a system when a recuperator is provided in order to heat the introducing fuel by the self-combustion heat.

At this time, the most important point is that it is preferable that the fuel/air spray nozzle of the second fuel/air supply line be positioned close to the rear part of the reforming reactor, because the ignition of the second fuel can be proceeded even if the amount of reformer is small.

It is more preferable that a preheating section be positioned at the rear part of the second fuel/air supply nozzle because the preheating/vaporizing of the second fuel/air mixture or fuel can be proceeded by the self-combustion heat, therefore the liquid fuel can be prevented from being supplied.

It is preferable that the heater/vaporizer positioned at the rear part of the second fuel/air supply nozzle have the shape to minimize effects on the flow of gas and a space capable of contacting a high temperature region, but no limit conditions are imposed.

The heater/vaporizer is mounted to have the shape where more than two are arranged in serial or in parallel in accordance with the applied vehicles (displacement volume), therefore it is possible to equalize the temperature in the heating device and to expand the heating volume.

In other words, the basic size of a catalyst reactor is maintained uniformly in accordance with the volume of exhaust gas, and a local hot part is formed and a plurality of suppliers are arranged in serial or in parallel at the wake of the flow of a gas. Thus, the adjustability to the magnitude of applications and the uniformity of temperatures can be improved.

In addition, the heating section and the evaporating section can utilize a heat source generated from ignition when they are positioned at the rear end of the second fuel/air supply nozzle, and a plurality of fuels can be vaporized and combusted to be supplied.

When the second fuels are not ignited but a combustion is proceeded in the DOC through a simple vaporization or reformation, there are limits in the combustible temperatures according to the increases of DOC volume.

According to the present invention, it is advantageous in that DOC could be excluded or maintained less, because the most fuels are combusted by igniting the second fuels.

The most important point of the present invention is to have an exhaust gas suction hole at the rear end of the reforming reactor so that a reformed gas is mixed with an exhaust gas. In addition, a fuel mixed with air is injected or an air and a fuel are alternately injected in order to prevent the fuel supply line from being blocked due to a carbon deposition.

Another invention is a device for manufacturing a reducing gas for removing nitrogen oxides in which a reducing gas for removing nitrogen oxides is manufactured from a predetermined gas, including the heating device for exhaust gas in the internal combustion engine.

At this time, a reducing gas can be obtained by a method for inducing incomplete combustion by increasing the amount of fuels supplied through a fuel/air supply line or decreasing the amount of exhaust gas introduced to a reactor. In order to obtain greater amount of a reducing gas, the second fuel injection nozzle is positioned at the region of low temperature where the second fuel cannot be ignited so that a reducing agent is mixed in the exhaust gas to be used as a reducing agent for removing NO at the rear end.

The present invention now will be described in detail with reference to the embodiments and the drawings.

FIG. 3 is a configurational view of a DPF heating system according to the present invention, equipped with heating devices for exhaust gas (1200, 1300) without adopting manners for supplying a fuel shown in FIG. 1 or 2.

The same fuel as that injected in the vehicles can be used and the other kinds of hydrocarbon can be utilized in a small generator which is operated in the same place. Air which is an oxiding agent is supplied through an external compressor.

FIG. 4 schematically shows a heating device for exhaust gas (1200) in accordance with the embodiment 1 according to the present invention.

The heating device for exhaust gas (1200), as shown in FIG. 4, comprises a reactor (500), an igniter (170), an ignition part (900) due to introducing exhaust gas, a means for second spraying fuels, a mixer (200) of combustion gas and exhaust gas, and a housing (100) including a space for moving the exhaust gas to form separate components for performing heating the exhaust gas. The mixer can obtain the same purpose even if it is positioned at the outside of the housing (100) for conveniently connecting a heating device.

A plurality of suction holes (910) are formed at the side of the ignition section (900) so that the exhaust gas is introduced into the combustion region (920). A small number of suctionholes (910) are formed at the front section of the combustion region (920) and a large number of suctionholes are formed at the rear section of the combustion region, therefore the amount of introducing air through the inflow hole (910) is gradually increased.

In addition, a separation plate (520) which is porous is provided between the ignition part (900) and the reactor (500) in order to fix the combustion/reforming catalyst (510).

There are no limits in the shapes of the reactor (500) but it is preferable that a cross-section of the introducing section (700) for introducing the exhaust gas and fuel, as shown in FIG. 4, be smaller than the cross-section of the section which is reacted by the combustion/reforming catalyst (510) in consideration that the volume of gas is expanded as a combustion proceeds.

The reacting section and the introducing section (700) can proceed with ignition promptly when the cross-section ratio is maintained in the range of 0.1~0.9 and the slipping of unburned hydrocarbon can be minimized.

Accordingly, the above catalyst reactor has a tapered connecting portion of two tubes with the different diameters, having a substantially a shape of a funnel.

As the operation of the catalyst reactor (500) employed in the present invention can be started through ignition with local heatings, the heating device for exhaust gas (1200) is driven in an engine idle state (100° C. of exhaust gas) regardless of driving conditions of vehicles (temperature of exhaust gas) to heat DPF and to provide with a reducing agent for removing nitrogen oxide.

Especially, in a driving method for maximizing the capability of the preferred reactor (500), the first fuel preheating line (320) for preheating the fuel supplied to the introducing part (700) is positioned at the rear end of the reactor (500) by thermal exchange of the combustion gas passed through the catalyst reactor (500).

The first pre-heating line (320) is connected to the first fuel supply line (300) connected to a fuel supply device which is not shown, and is bended several times inside the housing (100) to maximize the heat exchange area with the combustion hot gas.

In addition, the first fuel supply line (300) is connected to the first air supply line (310) for supplying air to supplement combustion. This is to supply air to the first fuel supply line (300) to keep a conduit from being blocked due to cokes generated by fuel prolysis.

The heating device for exhaust gas (1200) according to the embodiment 1 of the present invention has the second fuel preheating line (630) for supplying the second fuels at the rear end of the reactor (500) and a nozzle (620) at a terminal of the second fuel preheating line (630) inside housing (100).

The second pre-heating line (630) and the nozzle (620) are placed between the first pre-heating line (320) and the reactor (500).

The second pre-heating line (630) is connected to the second fuel supply line (600) connected to a fuel supply device which is not shown, and is bended several times inside the housing (100) to maximize the area contacting with the combusted hot gas.

In addition, the second fuel supply line (600) is connected to the second air supply line (610) for supplying air to supplement the combustion. This is to supply air to the second fuel supply line (600) to keep a conduit and the inside of the nozzle (620) from being blocked due to coke generated by fuel prolysis.

Accordingly, as the first fuel preheating line (300) and the second fuel preheating line (600) are intermittently supplied by air to remove a coke produced for a certain time, it is possible to minimize the amount of air supplied from the outside and at the same time to keep a tube from being blocked.

In addition, according to the characteristics of a combustion reforming catalyst (510), the reaction rate at the temperature over 800° C. is very high and the specific velocity of the reactant material is maintained very high (over 200,000/hr) resulting in minimizing the amount of precious metals of the catalyst.

A cross-section of reacting section filled with the combustion reforming catalyst (510) of the catalyst reactor (500) according to the embodiment 1 may be circular or polygonal but it can be anything. It is preferable that the expanding section of reactor have a diameter/diagonal line below than 50 mm, more preferably below 40 mm.

There are no special limitations on the catalyst (510) and the disclosed combustion catalyst and reforming catalyst can be used.

An igniter (170) is mounted in the introducing section (700) of the catalyst reactor (500), and the igniter (170) is connected to a heater connecting tube (140) inserted into the igniter connecting body (130) mounted on the wall body of the housing (100) and is supplied by a power via the power supply line (150) passing the igniter connecting tube (140).

In addition, the mixer (200) is mounted at the lower portion of the housing (100) to play a role in mixing a reformed gas and an exhaust gas which do not pass through the catalyst reactor and refrain from a damage of DOC so that a fuel is supplied uniformly to the DOC for burning a reforming gas.

The catalyst reactor (500) according to the present invention can uses the mixture of an oxidation catalyst and a reforming catalyst.

It is preferable that the content of the oxidizing catalyst be more than 80 wt % so as to increase the oxidation rate. It is more preferable that 100 wt % of oxidation catalyst be used in the entry where a light oil and air (or exhaust gas) are introduced and 100 wt % of reforming catalyst be used in the rear portion of the reactor. The embodiment shows a result of using 100 wt % of oxidation catalyst.

FIG. 5 shows a schematic cross-section of a reactor (501) according to the embodiment 2 of the present invention. In FIG. 5, the other portions which are not shown are the same to those in FIG. 4, and the same reference numerals are used in the following description.

The reactor (501) according to the embodiment 2 is the same as that in the embodiment 1 but an introducing tool (931) is mounted for focusing the exhaust gas at the outside of the inflow hole (911) toward the inflow hole (911), as shown in FIG. 5.

The introducing tool (931) has a substantially cone shape to have a decreasing radius toward the rear end of the inflow part (911).

Accordingly, the amount of exhaust gas flowing into the inflow hole (911) can be greatly increased in comparison with the ignition part (900) in the embodiment 1.

FIG. 6 shows a schematic cross-section of a reactor (502) according to the embodiment 3 of the present invention. In FIG. 6, the other portions which are not shown are the same as those in FIG. 4, and the same reference numerals are used in the following description.

The embodiment 3 has an introducing tube (932) mounted at the outside of the inflow hole for redirecting exhaust gas toward the inflow hole like the embodiment 2, as shown in FIG. 6, in order to increase the volume by increasing the amount of exhaust gas introduced into the ignition part (902).

The direction of the inflow hole formed at the ignition part (902) is substantially perpendicular to that of the exhaust gas flowing around the ignition part (902) like in the embodiment 1.

Accordingly, the exhaust gas is flown into the inflow hole by the difference of pressures in and out of the ignition part (902). Therefore, it is possible to improve the amount of exhaust gas introduced through the inflow hole by providing with the introducing tube (932) with a bended tube type so that the proceeding direction of the exhaust gas is forced to be identical to that of the inflow hole.

In comparison with the embodiment 2 and 3, the preferred one of the embodiment 2 is effective in that the ignition of a reforming gas proceeds promptly because the heating an exhaust gas passing through a hot part of the upper catalyst reactor is improved together with the compact outline.

FIG. 7 schematically shows the heating device an exhaust gas (1300) according to the embodiment 4 of the present invention.

Another configuration capable of obtaining the effects of the present invention, as shown in FIG. 7, is construed to introduce a part of air to an exhaust gas without providing the reactor (503) with air from the outside.

In other words, an suctioncone (713) for sucking an exhaust gas is integrally formed at the front end of the introducing part (700).

Due to the above configuration, the power for supplying air to the first fuel is expected to be minimized.

The embodiment 4 has the same configuration as the embodiment 1, except that the heater (1300) has the suctioncone (713) in the embodiment 4.

Next, a method for manufacturing a combination reforming catalyst (510) according to the present invention now will be described.

Platinum is used as an activating element and a supporter uses alumina. Prior to impregnating precious metals used as an activated metal, a cerous nitrate ($Ce(NO_3)_2.xH_2O$, Aldrich goods) is impregnated in activated alumina with 3~5 mm particulate (gamma-$Al_2O_3$, Canto goods) and dried at 105° C. for 24 hours and then fired at 1300° C. for 12 hours. The chloroplatinic acid ($H_2PtCl_6.xH_2O$, hangyul gold inc. goods) is dissolved in the completed complex supporter using a distilled water and then a platinum is impregnated. Each precursor material is added to include 10 wt % of cerium with reference to the supporter and 0.2 wt % of platinum with reference to the whole weight of the supporter. After platinum is impregnated, the supporter ($Pt/Ce/Al_2O_3$) is manufactured through the processes of drying at 105° C. for 24 hours and firing at 1000° C. for 24 hours.

An exhaust gas is heated using the catalyst combustors (1200, 1300) according to the present invention and there are no special conditions with respect to the types of DPF being the heated body or material characteristics. The combustors can be applied into filters of various types such as monory, foam or particle, consisting of ceramic series, metal series, SiC or SiN, which are currently commercialized.

The filters must have a heat resistance at least 900° C. because they may be locally overheated by a combustion of collected PM.

Furthermore, a method for lowering an operational temperature can be used in the filters using a precious metal oxidizing catalyst or by coating nitrogen occluded metals, also.

The major measuring positions and items for operating a system for heating DPF according to the present invention are as follows,

- pressure difference before and after DPF (ΔP)
- temperature (T1) of exhaust gas flowing into the catalyst combustor (500)
- temperature (T2) of exhaust gas of the catalyst combustor (500)
- temperature (T3) of the second combustion exhaust gas
- temperature (T4) of exhaust gas at the inlet of DOC
- temperature (T5) of exhaust gas at the outlet of DOC and the inlet of DPF
- temperature (T6) of exhaust gas at the outlet of DPF When a loss of pressure more than the reference is detected according to the increase of retention capacity of a particular matter in a process for monitoring the loss of pressure (ΔP), a power is supplied to an igniter to proceed with heating the combustion reforming catalyst (510).

If the temperature T1 is over 350° C., a process for supplying power can be omitted. If the temperature of the catalyst reactor (500) is lower than 350° C., a power is applied for 5~600 seconds and then a fuel is supplied.

If the temperature T2 of the catalyst reactor (500) reaches over 300° C., the power supplied to the heater may be halted.

The amount of fuels supplied to the catalyst reactor (500) is increased to raise the temperature T3 of the catalyst gas emission section over 600° C.

The second fuel is supplied to maintain the temperature T5 over 500° C. leading to proceed with reproduction of DPF (3000).

A fuel is supplied until the difference pressure ΔP is lower than the reference value to proceed with the reproduction.

The amount of supplied fuels is controlled so that the temperature T6 at the outlet of a filter do not reach 650° C. (changeable in accordance with the heat resistance of DPF) to include a safety mode for preventing a loss of a filter in ECU.

The test result of a heating device an exhaust gas of an internal-combustion engine according to the present invention now will be described in detail. The test example uses the embodiment 3.

Test Example 1

The reactor (502) uses ¾" tee of a stainless steel 316 in the air and fuel introducing part (702) and the reactor (502) is manufactured to have the structure where the diameter of the igniter is small and the diameter of the main reactor is extended using a pipe of a stainless steel 316 material with internal diameter of 35 mm. In the detailed description of the present invention, the described combusting catalyst (Pt/Ce/$Al_2O_3$) of 35 ml is crammed into the reactor (502).

The ignition part (902) has contacted two elbows with the diameter of ¼" and four elbows with the diameter of ⅜" on a side of a tube with the same diameter as that of the reactor (502) in order to follow configurations shown in FIG. 6, thus the ignition part (902) mixes an exhaust gas and a reforming gas.

An igniter (172) for initial heating is connected with an air and fuel supply line in the gas introducing part. The heater uses commercial products (heating plug for diesel vehicles) provided with a heater at an end portions of a screw so that it is diassembled in the outside.

For the second fuel supply, a wiring is manufactured with stainless steel tubes with the diameter of ⅛".

The reactor (502), the ignition part (902), the first fuel preheating line (320) and the second fuel preheating line (630) are mounted in the housing (100) with an internal diameter of 10 cm and the length of 25 cm.

The heater is mounted in the exhaust pipe of a vehicle in the order shown in FIG. 3 and its capacity is measured. The temperatures T4 and T5 at the inlet and the outlet of the DOC (general merchandises for 2.5 L engine) and the surrounding temperatures T1 and T2 of the heating device exhaust gas (1200) are measured without the DPF (3000).

A 2.5 L diesel vehicle with a supercharger is used in the test. After an engine is driven, a no-load idling (1300 rpm) state is maintained for 30 minutes and the state of heating an exhaust gas is monitored using the device (1200) for heating exhaust gas in the condition that the temperature of exhaust gas is maintained at a steady state.

A direct current with 24V is supplied to the igniter (171) for three minutes and air and fuel are supplied so as to drive the device. After the ignition, the amount of air and fuel is changed as shown in FIG. 8. Air is supplied using a compressor and a light oil is supplied using a liquid pump. The temperatures at each portion are monitored with an interval of one second as an experimental time goes by.

According to the experimental results, as shown in FIG. 9, the exhaust gas below 100° C. can be heated over 550° C. which is the temperature of DPF.

In addition, it is obtained that the amount of supplied fuel and the temperature at the rear end of DOC have a linear relationship as shown in FIG. 10.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A heating device for exhaust gas in an internal combustion engine, comprising:

a tubular housing;

a catalyst reactor equipped in the housing, filled with a combustion reforming catalyst in order to burn/reform the exhaust gas and having an introducing section with an igniter equipped in the front end of the catalyst reactor, and a first fuel preheating line connected to a fuel supply device from the outside of the housing to be supplied with fuels;

an ignition part integrally formed at the rear end of the reactor so as to ignite a combustible gas partially mixed with the exhaust gas from the reactor and the exhaust gas flowing between the reactor and the housing;

a nozzle mounted at the rear end of the ignition part to be provided with a fuel from a second fuel preheating line, spray the fuel to the exhaust gas and combust the exhaust gas secondarily;

a mixer mounted at the rear end of the catalyst reactor for mixing the combustible gas by way of the combustion reforming catalyst and the exhaust gas flowing between the catalyst reactor and the housing; and a plurality of suction holes formed at the outer circumference of the ignition part, wherein the exhaust gas about the outer circumference of the ignition part flows through the suction holes.

2. The device of claim 1, further comprising a separation plate having a plurality of holes so that the combustion reforming catalyst is fixed between the catalyst reactor and the ignition part and a combustible reforming gas is passed through the separation plate.

3. The device of claim 1, further comprising an suction cone for sucking the exhaust gas at the front end of the introducing section of the catalyst reactor.

4. The device of claim 1, wherein the first fuel preheating line and the second fuel preheating line are bent more than once in the housing.

5. The device of claim 1, wherein the first fuel preheating line and the second fuel preheating line are connected to a first fuel supply line and a second fuel supply line, respectively and at the same time the first fuel supply line and the second fuel supply line are connected to a first air supply line and a second air supply line, respectively to be provided with air.

6. The device of claim 5, wherein the first fuel preheating line and the second fuel preheating line are alternately provided with air and fuel.

7. The device of claim 1, wherein the number or diameter of the suction holes increases toward the rear end of the ignition part resulting in an increased amount of exhaust gas flowing through the suction holes.

8. The device of claim 1, further comprising an introducing tool to increase the amount of exhaust gas flowing into the suction holes, wherein the introducing tool has a cone shape with a decreasing surface area toward the rear end of the ignition part.

9. The device of claim 1, further comprising an introducing tube integrally formed at the suction holes about the outer circumference of the ignition part to increase the amount of exhaust gas flowing into the suction holes, wherein the introducing tube is bent and includes portions that are parallel and vertical to the exhaust gas.

10. A method for heating a catalyst agent for removing nitrogen oxides using the heating device for exhaust gas according to claim 1.

11. A method for providing a reducing agent for removing nitrogen oxides using the heating device for exhaust gas according to claim 1.

* * * * *